US007449643B2

(12) United States Patent
Nakade

(10) Patent No.: US 7,449,643 B2
(45) Date of Patent: Nov. 11, 2008

(54) SWITCH FOR VEHICLE

(75) Inventor: Yoshiyuki Nakade, Fukui (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 11/687,930

(22) Filed: Mar. 19, 2007

(65) Prior Publication Data

US 2007/0284238 A1 Dec. 13, 2007

(30) Foreign Application Priority Data

Jun. 8, 2006 (JP) ..... 2006-159437

(51) Int. Cl.
*H01H 13/00* (2006.01)

(52) U.S. Cl. ..... 200/16 D

(58) Field of Classification Search ..... 200/310–317, 200/532, 531, 536, 16 D
See application file for complete search history.

(56) References Cited

U.S. PATENT DOCUMENTS 4,179,594 A * 12/1979 Coyle et al. ..... 200/310
6,512,191 B1 * 1/2003 Makino et al. ..... 200/531
6,799,877 B2 * 10/2004 Watkins et al. ..... 362/542
6,864,786 B2 * 3/2005 Speckhart et al. ..... 200/61.45 R
6,930,261 B2 * 8/2005 Nakade ..... 200/302.2
7,280,375 B2 * 10/2007 Joos ..... 362/265

FOREIGN PATENT DOCUMENTS

JP 2003-151398 A 5/2003

* cited by examiner

*Primary Examiner*—Edwin A. Leon
(74) *Attorney, Agent, or Firm*—RatnerPrestia

(57) ABSTRACT

A switch for a vehicle used to control the on-off operation of a stop lamp for an automobile ensures electrical contact and separation with a simple structure. The switch includes an input terminal and an output terminal each protruded outside the case at one end and is disposed in the case at the other end. Between the input terminal and the output terminal is disposed a switching unit having an input part, an output part, and a signal input part. The input part and the output part are connected to the input terminal and the output terminal, respectively. Between the signal input part of the switching unit and the input terminal is disposed a switch contact, which slides to perform electrical contact and separation in response to the vertical motion of the operating body accommodated in the case.

7 Claims, 5 Drawing Sheets

SWITCH FOR VEHICLE

BACKGROUND OF THE INVENTION

1. Field of the Invention

The present invention relates to a switch for a vehicle, which is mainly used to control the on-off operation of a stop lamp in response to the operation of the brake pedal of an automobile.

2. Background Art

In recent years, press-type switches for vehicles have been increasingly used to control a stop lamp that lights when the brake pedal is depressed and goes out when released.

Such a conventional switch for a vehicle is described with reference to FIG. 5.

FIG. 5 is a sectional view of a conventional switch for a vehicle. The switch includes substantially box-shaped, open-top case 1 made of insulating resin, and operating body 2 also made of insulating resin. Case 1 has a plurality of fixed contacts 3 embedded therein, with terminal parts 3A of fixed contacts 3 being protruded from the bottom surface of case 1.

The switch further includes pressure-contact spring 5, which brings movable contact 4 made of a conductive metal into elastic contact with fixed contacts 3 from below, so that fixed contacts 3 are electrically connected to each other via movable contact 4, thereby forming a switch contact. Pressure-contact spring 5 is held in a slightly compressed condition between the bottom surface of case 1 and movable contact 4.

The switch further includes coiled return spring 6 in a slightly compressed condition between the bottom surface of operating body 2 and the bottom surface of case 1 so as to bias operating body 2 upward.

The switch further includes cover 7, which covers the open top of case 1 and has hollow cylindrical part 7A protruding upward. Operating body 2 has operating shaft 2A, which moves up and down in hollow cylindrical part 7A. The top end of operating shaft 2A is protruded upward from hollow cylindrical part 7A.

The switch for a vehicle thus structured is generally installed just before the brake pedal of an automobile, with operating shaft 2A of operating body 2 pressed by an arm or the like, and with terminal parts 3A of fixed contacts 3 connected to the power supply and the stop lamp via connectors or the like.

More specifically, when the brake pedal is not depressed, operating shaft 2A of operating body 2 is pressed downward so as to compress pressure-contact spring 5 and return spring 6, thereby moving movable contact 4 downward away from fixed contacts 3. In this condition, fixed contacts 3 are electrically disconnected from each other, and therefore, the stop lamp is out.

When the brake pedal is depressed, on the other hand, the arm leaves operating shaft 2A to remove the pressure, allowing the elastic restoring force of return spring 6 to move operating body 2 upward. Movable contact 4 is also pressed by pressure-contact spring 5 so as to come into elastic contact with fixed contacts 3. As a result, fixed contacts 3 are electrically connected to each other so as to connect the stop lamp to the power supply, thereby illuminating the stop lamp.

The switch for a vehicle is installed near the brake pedal of the automobile exposed to a comparatively high level of dust, gas, moisture, and the like. Furthermore, the arm or the like to press operating shaft 2A of operating body 2 is generally coated with a lubricant or the like. Therefore, the lubricant, gas, dust, moisture, and the like may enter the inside of the switch for a vehicle from operating, shaft 2A, hollow cylindrical part 7A, or the gap between case 1 and cover 7.

The switch contact of the switch for a vehicle has the aforementioned structure in which pressure-contact spring 5 allows movable contact 4 to move up and down so as to come into contact or to separate from fixed contacts 3 arranged opposite to movable contact 4. The lubricant, gas, dust, moisture, and the like entered the inside of the switch may adhere to fixed contacts 3 or movable contact 4 so as to generate carbides or silicides on their surfaces. The generation of these compounds may disrupt the electrical contact and separation between the contacts.

In an attempt to prevent the adherence of the lubricant, gas, dust, moisture, and the like to the surfaces of the contacts, the switch for a vehicle is generally sealed, for example, by covering operating shaft 2A or hollow cylindrical part 7A with a rubber cap or by applying an adhesive agent or a shielding material to the gap between case 1 and cover 7.

One such conventional device is disclosed in Japanese Patent Unexamined Publication No. 2003-151398.

The conventional switch for a vehicle, however, is required to have a sealed structure to achieve stable electrical contact and separation between the contacts. This causes an increase not only in the number of components but also in the time required for the assembly of the switch.

SUMMARY OF THE INVENTION

The present invention solves these conventional problems and provides a switch for a vehicle which ensures electrical contact and separation with a simple structure.

The switch for a vehicle of the present invention includes an input terminal, an output terminal, and a switching unit disposed between these terminals. Each of the input terminal and the output terminal is protruded outside a case at one end and disposed in the case at the other end. The switching unit includes an input part connected to the input terminal and an output part connected to the output terminal.

The switch for a vehicle further includes a switch contact disposed between the signal input part of the switching unit and the input terminal. The switch contact performs electrical contact and separation in response to the vertical motion of the operating body accommodated in the case. This structure allows the switch contact to be a slidable type by using a metal plate or the like for minute current. This structure also allows the switching unit such as a field effect transistor to control the on-off operation of the stop lamp so that the switch for a vehicle can ensure electrical contact and separation with a simple structure without the influence of the surrounding lubricant, gas, dust, moisture or the like.

DETAILED DESCRIPTION OF THE INVENTION

An embodiment of the present invention is described as follows with reference to FIGS. 1 to 4.

Embodiment

Figure 1:
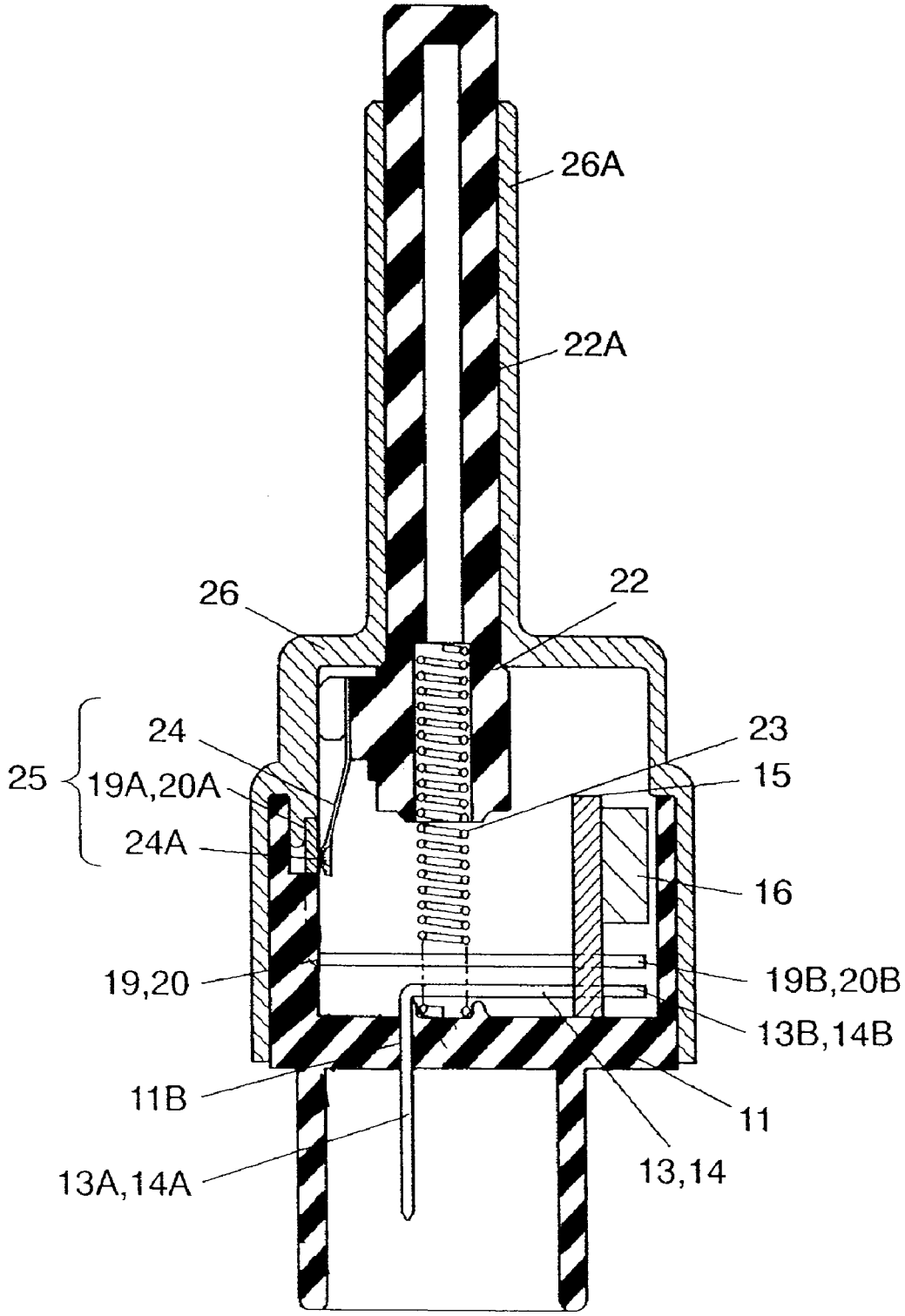
FIG. 1 is a sectional view of a switch for a vehicle according to an embodiment of the present invention.
Figure 2:
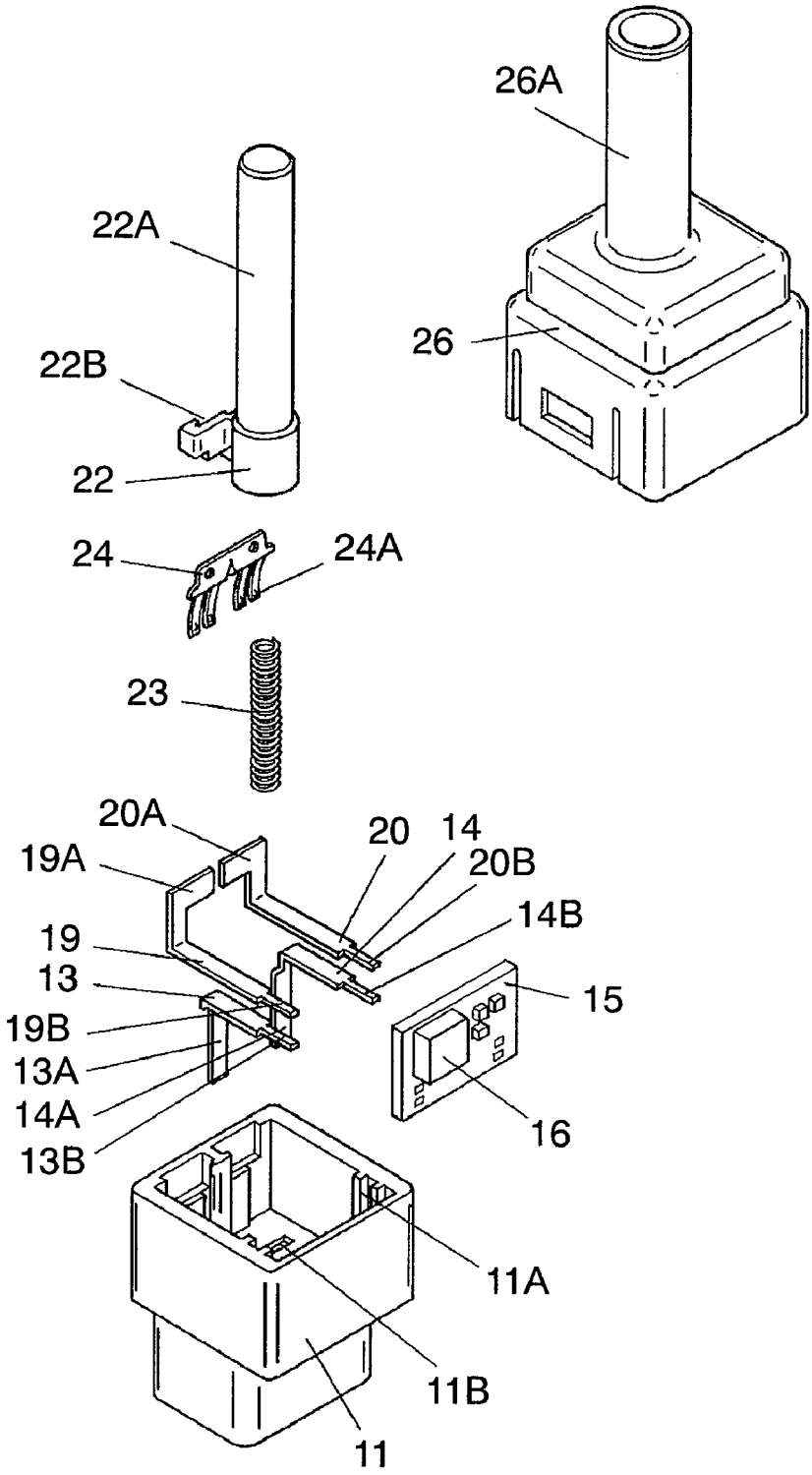
FIG. 2 is an exploded perspective view of the switch for a vehicle according to the embodiment of the present invention.
Figure 3:
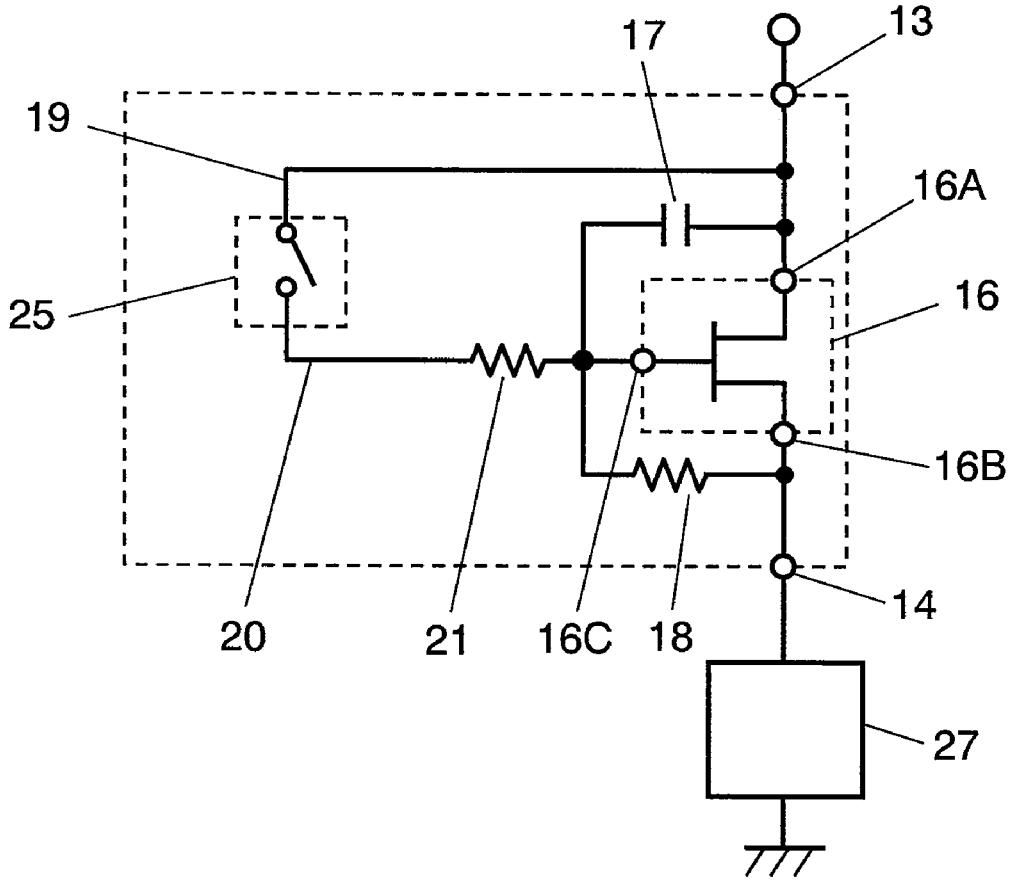
FIG. 3 is a circuit diagram of the switch for a vehicle according to the embodiment of the present invention.
Figure 4:
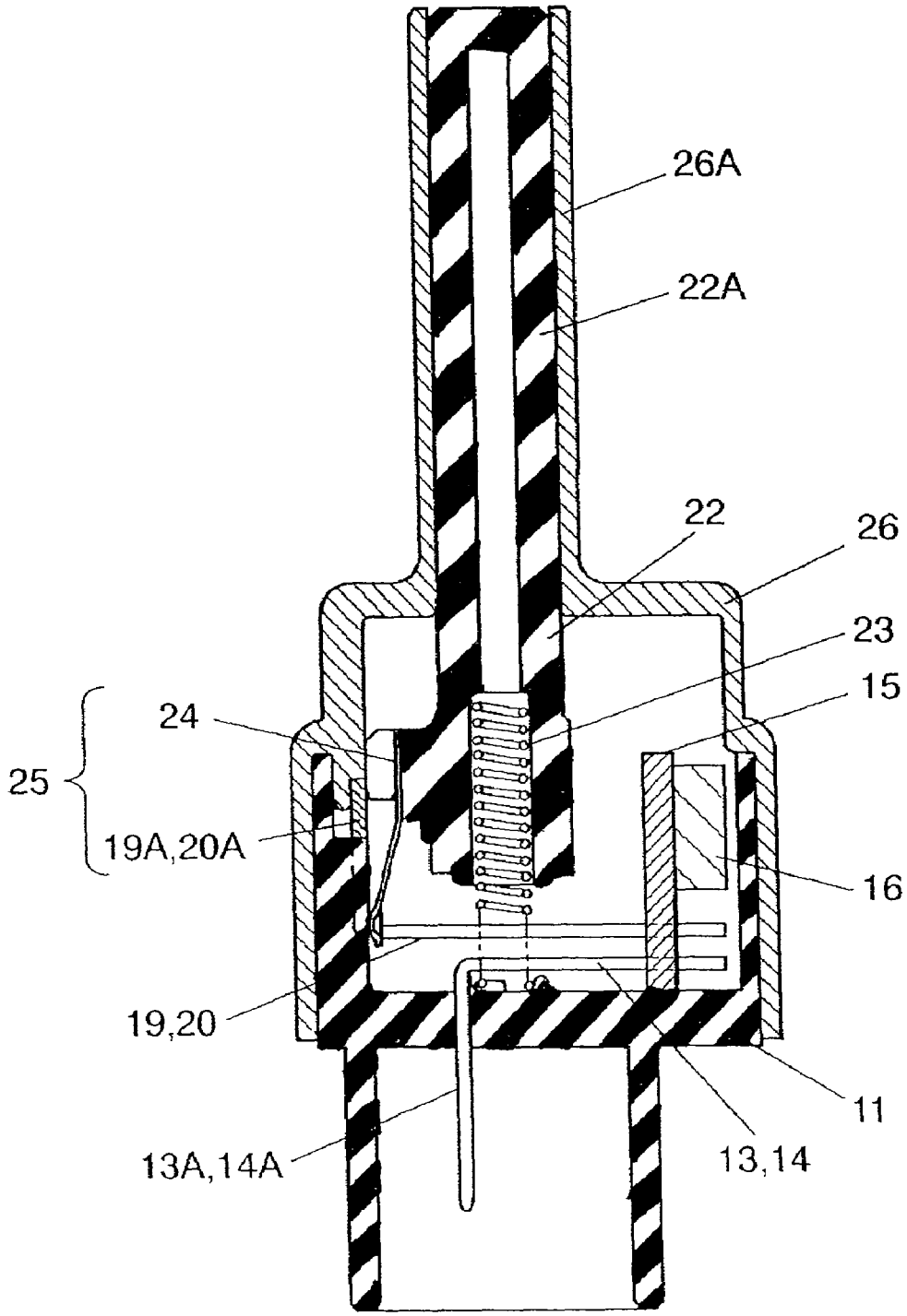
FIG. 4 is a sectional view of the switch for a vehicle according to the embodiment of the present invention when in operation.
Figure 5:
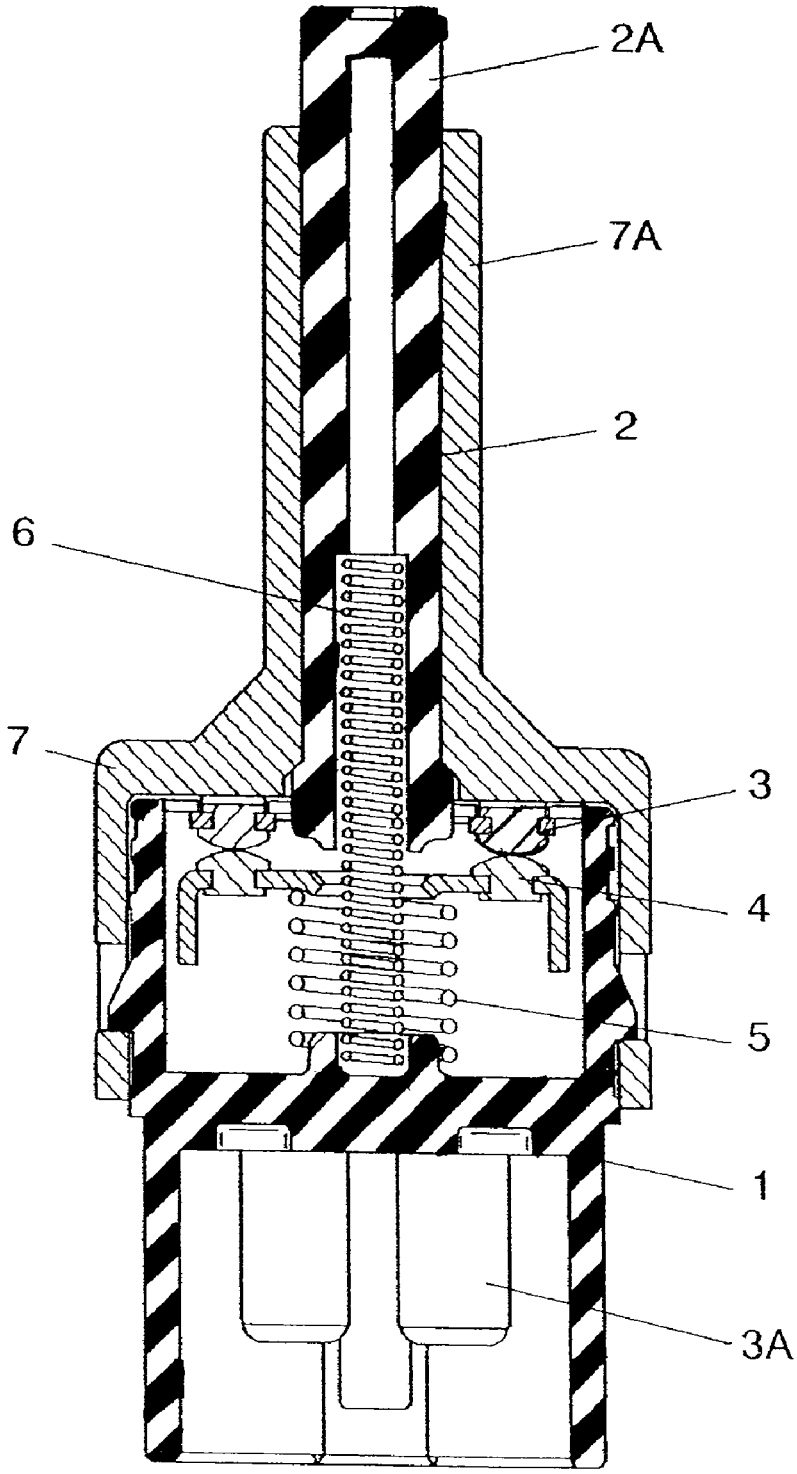
FIG. 5 PRIOR ART
FIG. 5 is a sectional view of a conventional switch for a vehicle.

FIG. 1 is a sectional view of a switch for a vehicle according to an embodiment of the present invention. FIG. 2 is an exploded perspective view of the switch for a vehicle, FIG. 3 is a circuit diagram of the switch for a vehicle, and FIG. 4 is a sectional view of the switch for a vehicle when in operation. The switch for a vehicle includes substantially box-shaped, open-top case 11 made of insulating resin, and input terminal 13 and output terminal 14, each made of a conductive metal plate bent like an L and disposed in case 11. Input terminal 13 and output terminal 14 are provided at one end thereof with terminal part 13A and terminal part 14A, respectively, which are protruded outside from the bottom surface of case 11.

The switch for a vehicle further includes wiring board 15, which is substantially perpendicular to the bottom surface of case 11 and, held in case 11 by retaining groove 11A formed therein. Wiring board 15 has a plurality of wiring patterns (unillustrated) on both surfaces thereof and is connected to connecting part 13B and connecting part 14B, which are provided at the other end of input terminal 13 and output terminal 14, respectively.

Wiring board 15 is mounted with switching unit 16, which is, for example, a MOS-FET (field effect transistor). Switching unit 16 has input part 16A such as a drain portion, output part 16B such as a source portion, and signal input part 16C such as a gate portion. Input part 16A and output part 16B are respectively connected to input terminal 13 and output terminal 14 via respective wiring patterns. Between signal input part 16C and input part 16A is connected capacitor 17 for noise absorption, and between signal input part 16C and output part 16B is connected resistor 18 for stabilizing the input voltage to be supplied to signal input part 16C.

Capacitor 17 absorbs noise in order to prevent malfunction of switching unit 16 due to the noise superimposed on the harness between the automobile battery and the input terminal 13.

The switch for a vehicle further includes connecting terminal 19, which is made of a conductive metal plate bent like an L and has connecting part 19B at one end and fixed contact 19A at the other end. Connecting part 19B is connected between input terminal 13 and input part 16A, and fixed contact 19A is bent substantially in parallel with the inner surface of case 11.

The switch for a vehicle further includes connecting terminal 20, which is also like an L and has connecting part 20B at one end and fixed contact 20A at the other end. Connecting part 20B is connected to signal input part 16C via current limiting resistor 21. Fixed contact 20A is bent substantially in parallel with the inner surface of case 11 so as to be arranged side-by-side with fixed contact 19A on the inner surface of case 11.

The switch for a vehicle further includes operating body 22 and return spring 23. Operating body 22, which is substantially cylindrical and made of insulating resin, is accommodated in a vertically movable manner in case 11. Return spring 23 is disposed in a slightly compressed condition between the bottom surface of case 11 and the bottom end of operating body 22, thereby biasing operating body 22 upward.

The switch for a vehicle further includes movable contact 24, which is substantially U-shaped and made of an elastic conductive metal plate. Movable contact 24 has a fixed part on the upper portion thereof, which is fixed to holding part 22B provided on the left side of operating body 22 (hereinafter, "right side" and "left side" respectively correspond to the right side and the left side in FIG. 1). Movable contact 24 has a plurality of contacts 24A protruding downward like arms on both sides of the fixed part. Contacts 24A are in elastic contact with the surfaces of fixed contacts 19A and 20A in a slightly compressed condition, thereby forming switch contact 25. Switch contact 25 is disposed between input terminal 13 and signal input part 16C.

The switch for a vehicle further includes cover 26 which is made of insulating resin and has hollow cylindrical part 26A protruding upward. Operating body 22 has operating shaft 22A on the upper portion thereof, and operating shaft 22A moves up and down in hollow cylindrical part 26A. Cover 26 coats the opening on the top surface of case 11.

A method for manufacturing the switch for a vehicle is described as follows with reference to FIG. 2.

First, connecting parts 13B and 14B of input terminal 13 and output terminal 14 are mounted and connected by soldering or the like to predetermined positions of wiring board 15, which is mounted with electronic components such as switching unit 16, capacitor 17, and resistor 18. In the same manner, connecting parts 19B and 20B on one end of connecting terminals 19 and 20, respectively, are mounted and connected by soldering or the like to wiring board 15.

Then, wiring board 15 mounted with these predetermined electrical components is press fit from above into retaining groove 11A formed on the right side of case 11. Terminal parts 13A and 14A of input terminal 13 and output terminal 14 are inserted into through holes 11B formed in the bottom surface of case 11 and then fixed to case 11 by press fitting, caulking, or the like. As a result, fixed contacts 19A and 20A of connecting terminals 19 and 20 are arranged side-by-side with each other on the left side of the inner surface of case 11.

When accommodated in case 11, wiring board 15 is mounted integrally with the electronic components, input and output terminals 13 and 14, connecting terminals 19 and 20, and the like, making it easy to install these components and terminals in case 11.

Next, return spring 23 is disposed on the bottom surface of case 11. Then, wiring board 15 mounted with these components and terminals is inserted into case 11 from above together with cover 26 in such a manner that the bottom end of operating body 22 comes into contact with the top end of return spring 23, with movable contact 24 fixed to holding part 22B. Thus, the switch for a vehicle is completed.

As shown in the sectional view of FIG. 4, the switch for a vehicle thus structured is generally installed just before the brake pedal of an automobile with operating shaft 22A of operating body 22 pressed by an arm or the like. Terminal part 13A of input terminal 13 is connected to a power supply such as a battery via a connector or the like, and terminal part 14A of output terminal 14 is connected to stop lamp 27 of the automobile.

More specifically, when the brake pedal is not depressed, operating shaft 22A of operating body 22 is pressed downward so as to compress return spring 23, thereby moving movable contact 24 downward away from fixed contacts 19A and 20A. In this condition, fixed contacts 19A and 20A are electrically disconnected from each other, and therefore, switch contact 25 is in the off state.

Consequently, signal input part 16C of switching unit 16 is not supplied with a predetermined signal from switch contact 25. This interrupts the flow of current between input part 16A and output part 16B of switching unit 16, thereby placing stop lamp 27 in the off state.

When the brake pedal is depressed, on the other hand, the arm leaves operating shaft 22A to remove the pressure, allowing the elastic restoring force of return spring 23 to move operating body 22 upward as shown in FIG. 1. Movable contact 24 is also moved upward so as to make contacts 24A slide and come into elastic contact with fixed contacts 19A and 20A. In other words, switch contact 25 is turned on.

At this moment, switch contact 25 is supplied with a current of only several mA at 12 Vdc because of being connected to current limiting resistor 21 via connecting terminal 20.

This minute current is supplied from input terminal 13 to signal input part 16C of switching unit 16 via switch contact 25. In switching unit 16, input part 16A and output part 16B are electrically connected to each other. As a result, when stop lamp 27 is an LED, a current of about 1 A at 12 Vdc is supplied from the power supply via input terminal 13 so as to light stop lamp 27.

Switch contact 25, which performs electrical contact and separation in response to the vertical motion of operating body 22, is formed of movable contact 24 and fixed contacts 19A and 20A made of a metal plate for minute current. Every time switch contact 25 performs electrical contact or separation, movable contact 24 is slidably brought into elastic contact with fixed contacts 19A and 20A so as to turn switch contact 25 on or off. Consequently, when the switch for a vehicle is used in a place exposed to a high level of gas, dust, moisture, or lubricant, if the contacts have these materials adhered to their surfaces, these materials are removed by the sliding operation of movable contact 24. This so-called self cleaning enables stable electrical contact and separation between the contacts.

Stop lamp 27, which is supplied with a comparatively large current, is turned on or off by switching unit 16, which is an electronic component such as a MOS-FET (field effect transistor) having no mechanically movable part unlike switch contact 25. This ensures electrical contact and separation without the influence of the surrounding lubricant, gas, dust, moisture or the like.

As described hereinbefore, according to the present embodiment, each of input terminal 13 and output terminal 14 is protruded outside case 11 at one end thereof and disposed in case 11 at the other end thereof. Between input terminal 13 and output terminal 14 is disposed switching unit 16, which has input part 16A connected to input terminal 13 and output part 16B connected to output terminal 14. Between signal input part 16C of switching unit 16 and input terminal 13 is disposed switch contact 25, which performs electrical contact and separation in response to the vertical motion of operating body 22 accommodated in case 11. This structure allows switch contact 25 to be a slidable type by using a metal plate or the like for minute current. This structure also allows the switch for a vehicle to ensure electrical contact and separation with a simple structure without the influence of the surrounding lubricant, gas, dust, moisture or the like.

Furthermore, wiring board 15 mounted with switching unit 16 and the electronic components is also mounted integrally with input terminal 13, output terminal 14 and connecting terminals 19 and 20, and is press fit from above into retaining groove 11A of case 11. This makes it easy to install wiring board 15 in case 11, thereby facilitating the assembly.

In the aforementioned description, switching unit 16 is formed of a MOS-FET and supplied with a current of 1 A to 3 A for an LED. When stop lamp 27 is an electric bulb or the like, however, a larger amount of current can be supplied by using a power transistor or the like.

Also in the aforementioned description, fixed contacts 19A and 20A are formed at the other end of connecting terminals 19 and 20, respectively, and movable contact 24 formed on the left side surface of operating body 22 is slidably brought into elastic contact with fixed contacts 19A and 20A, thereby forming switch contact 25. Alternatively, the present invention can use switch contacts of various structures as long as a minute current is started or stopped in response to the vertical motion of operating body 22 as follows. For example, wiring board 15 may be provided on the left side surface thereof with a plurality of patterned fixed contacts, and operating body 22 may be provided on the right side surface thereof with a movable contact made of an elastic conductive metal plate. This structure allows the movable contact to slide and come into elastic contact with the fixed contacts in response to the vertical motion of operating body 22. As another example, both surfaces of each of the fixed contacts may be sandwiched between both ends of a substantially U-shaped movable contact.

The switch for a vehicle according to the present invention ensures electrical contact and separation with a simple structure, and therefore is useful mainly for the on-off operation of the stop lamp for an automobile.

What is claimed is:

1. A switch for a vehicle comprising:

a case;

a movable contact;

a fixed contact;

an input terminal and an output terminal, the input terminal and the output terminal each being protruded outside the case at one end and disposed in the case at an other end;

an operating body accommodated in the case in a vertically movable manner;

a switch contact performing electrical contact and separation in response to a vertical motion of the operating body, wherein the switch contact performs electrical contact and separation between the movable contact and the fixed contact in response to the vertical motion of the operating body;

a switching unit disposed in the case between the input terminal and the output terminal, wherein the switching unit includes an input part, an output part, and a signal input part, the input part being connected to the input terminal and the output part being connected to the output terminal, the switch contact is disposed between the signal input part of the switching unit and the input terminal, and the switching unit is conductive from the input part to the output part responsive to a signal applied to the signal input part by the switch contact; and a wiring board disposed in the case is mounted integrally with the input terminal, the output terminal, the switching unit and the connecting terminal, wherein the switch contact is disposed between the signal input part of the switching unit and the input terminal through a connecting terminal;

said case having an opening extending from outside said case to inside said case.

2. The switch for a vehicle of claim 1, wherein the switching unit turns on and off a larger current than the switch contact.

3. The switch for a vehicle of claim 1, wherein the switching unit is a switching device which is transistorized.

4. The switch for a vehicle of claim 1, wherein the switch contact is turned on and off by sliding a movable contact thereof relative to a fixed contact thereof in response to the vertical motion of the operating body.

5. The switch for a vehicle of claim 4, wherein the switching unit turns on and off a larger current than the switch contact.

6. The switch for a vehicle of claim 1, wherein the wiring board is disposed substantially perpendicular to the bottom surface of the case and held in the case by a retaining groove formed therein.

7. The switch for a vehicle of claim 6, wherein the connecting terminal is L-shaped, one end of the connecting terminal is connected to the wiring board nearly perpendicular, and the other end is bent substantially in parallel with the inner surface of the case producing the fixed contact facing the wiring board, and the electrical contact and separation between the movable contact and the fixed contact is performed by moving the movable contact to come into contact with the fixed contact.

* * * * *